US006655573B1

(12) United States Patent
Chang et al.

(10) Patent No.: US 6,655,573 B1
(45) Date of Patent: Dec. 2, 2003

(54) SCREWS DISPENSING DEVICE

(75) Inventors: Shin-Nan Chang, Taichung (TW); Chun-Chih Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/298,072

(22) Filed: Nov. 18, 2002

(51) Int. Cl.[7] ..... B25C 1/04

(52) U.S. Cl. ..... 227/109; 227/136; 227/138; 227/142; 81/434

(58) Field of Search ..... 227/109, 136, 227/120, 135, 138, 142; 81/434, 435, 57.37

(56) References Cited

U.S. PATENT DOCUMENTS 5,996,874 A * 12/1999 Fukushima et al. ..... 227/136
6,089,132 A * 7/2000 Habermehl ..... 81/434
6,296,166 B1 * 7/2001 Matsuo et al. ..... 227/119
6,363,818 B1 * 4/2002 Habermehl ..... 227/136
6,568,302 B2 * 5/2003 Tucker et al. ..... 81/434

* cited by examiner

*Primary Examiner*—Scott A. Smith
(74) *Attorney, Agent, or Firm*—Charles E. Baxley

(57) ABSTRACT

A screw dispensing device includes a pushing member which is connected to the slide piece so as to simplify the processes of operation of the device. A movable positioning plate allows the screws with different sizes to be easily inserted in the barrel of the device. A rotatable adjusting knob is pivotably connected to the rear end of the positioning plate and controls the movement of the positioning plate so as to adjust the depth of feeding of the screws.

1 Claim, 12 Drawing Sheets

SCREWS DISPENSING DEVICE

FIELD OF THE INVENTION

The present invention relates to a screw dispensing device and the device makes the screws be dispensed in a stable status, and screws with different sizes can be conveniently and easily replaced and engaged with the device.

BACKGROUND OF THE INVENTION

A conventional screw dispenser device is shown in FIGS. 1 and 2, and generally includes a sleeve 10 and a barrel which is connected to the sleeve 10 by a spring bush. A slide piece 12 is connected to a side of the barrel 11 and moves up and down with the relative movement of the barrel 11 and the sleeve 10. An L-shaped pushing member 13 is pivotably connected to the slide piece 12 and a lever 131 extends from the pushing member 13 and protrudes out from the slide piece 12. The lever 13 controls the pushing member 13 by a spring. A control shaft 14 is connected to the sleeve 10 and one end of the control shaft 14 contacts against one of the stepped surfaces of the stop member 15, and the other end of the control shaft 14 contacts the barrel 11. When changing the screws, the user has to shift the lever 131 of the pushing member 13 so as to engage the screws and pull the screws out. The finger feels paint to press on the lever 131. The inner diameter of the barrel 11 is fixed so that the screws with smaller specification cannot be securely positioned in the barrel 11. When using longer screws, the long screws could tilt when being dispensed because the distance between the screws and the barrel 11 is too far. A hole has to be drilled in the sleeve 10 to receive the control shaft 14.

The present invention intends to provide a screw dispensing device wherein the slide piece and the pushing member are connected with each other to simplify the process of operation. An adjusting knob is used to control the travel length of the positioning plate so as to accommodate the screws with different sizes.

SUMMARY OF THE INVENTION

In accordance with one aspect of the present invention, there is provided a screw dispensing device and the primary object of the present invention is to provide a pushing member which is connected to the slide piece so as to simplify the processes of operation of the device. A rotatable adjusting knob is pivotably connected to the rear end of the positioning plate and controls the movement of the positioning plate.

Another object of the present invention is to provide a screw dispensing device wherein a movable positioning plate makes the screws with different sizes be easily inserted in the barrel of the device. It is not necessary to change the barrel when using different size of screws. The rotatable adjusting knob adjusts the depth of feeding of the screws.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
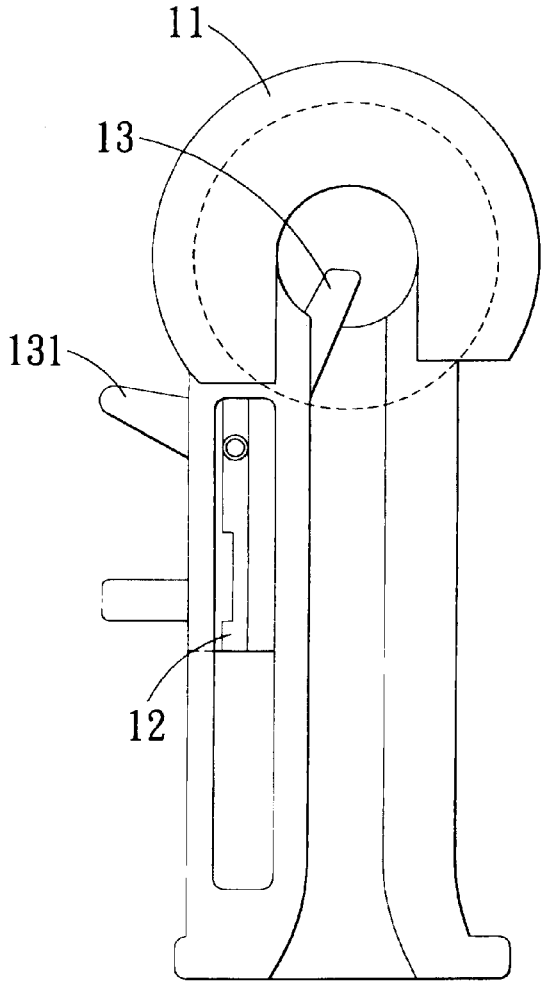
F I G. 1 PRIOR ART
FIG. 1 is an end view to show a conventional screw dispensing device.
Figure 2:
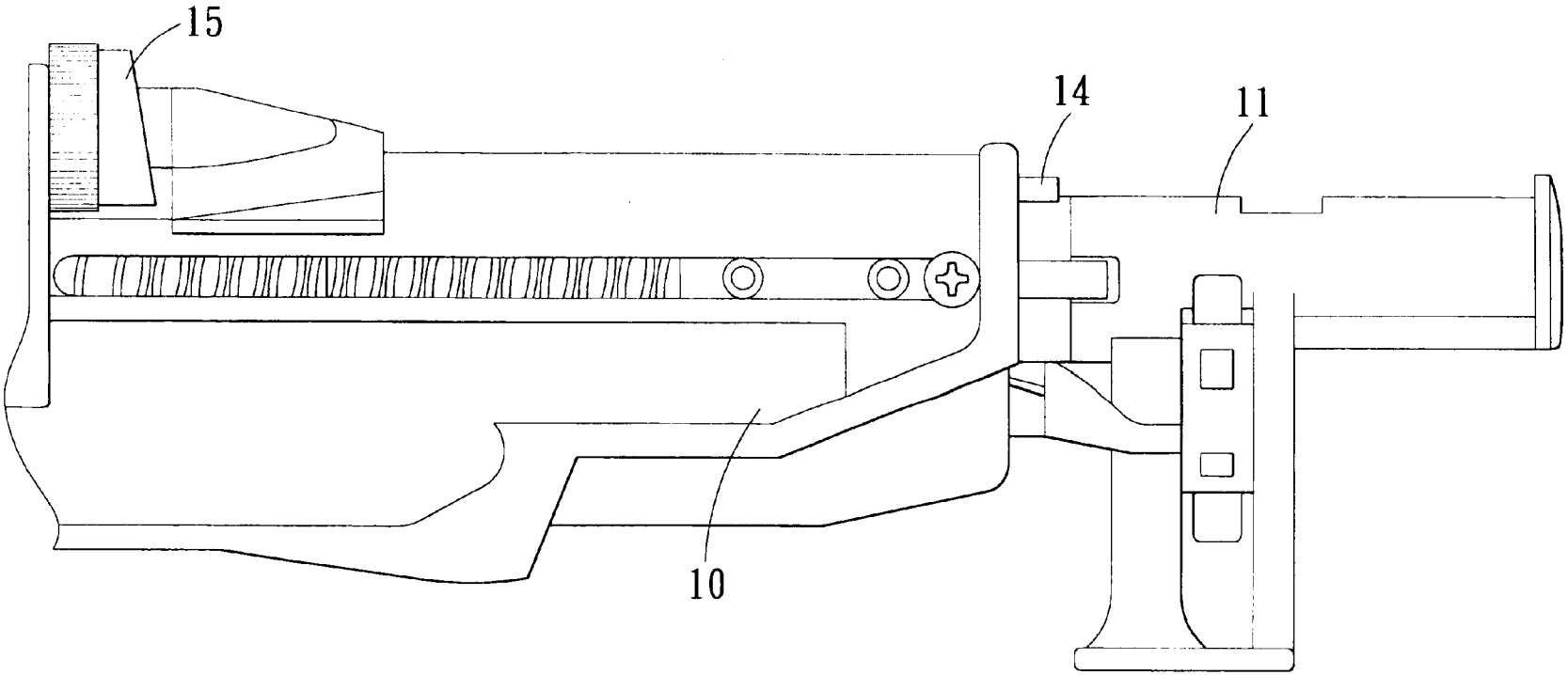
FIG. 2 PRIOR ART
FIG. 2 is a side view of the conventional screw dispensing device.
Figure 3:
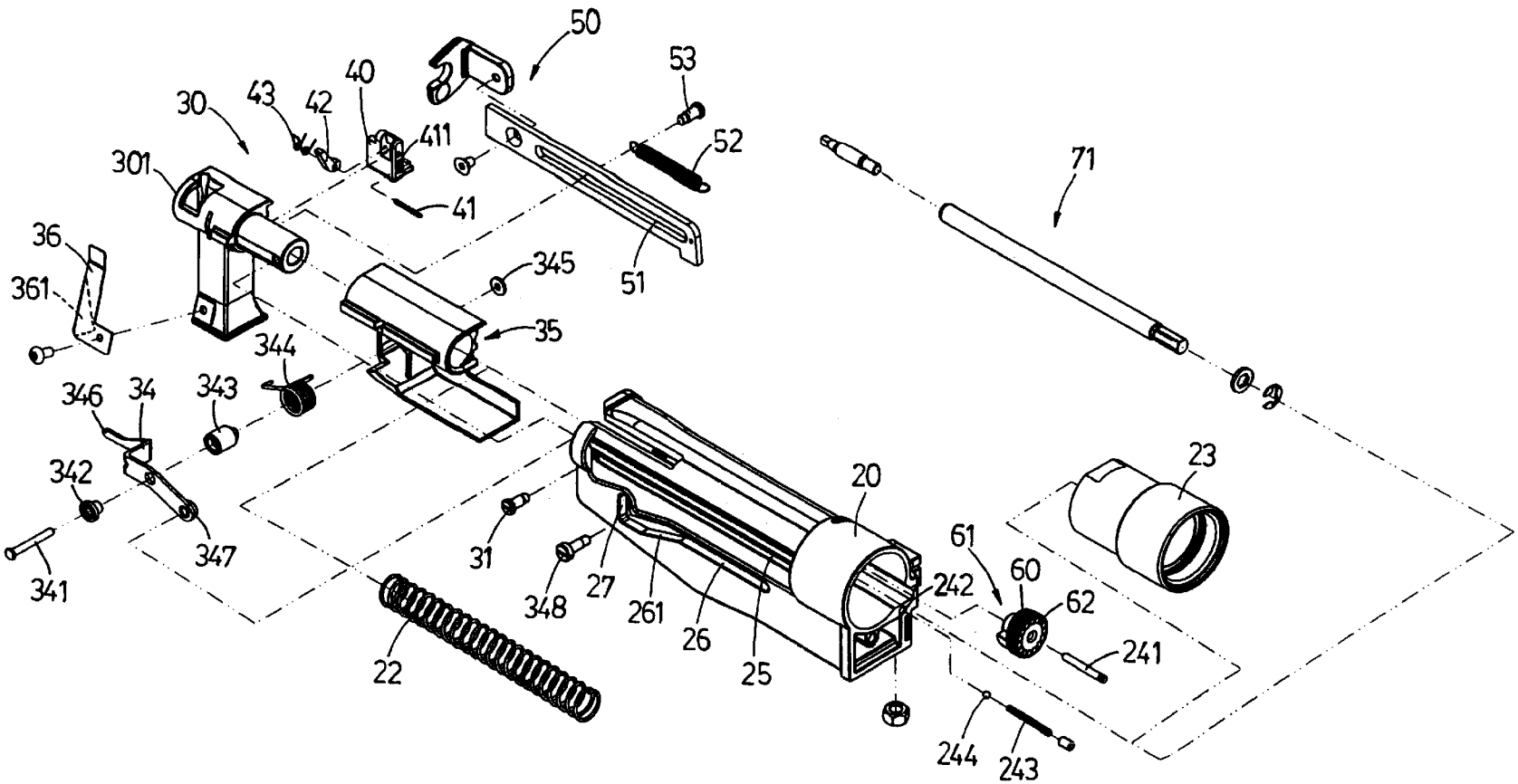
FIG. 3 is an exploded view to show the screw dispensing device of the present invention.
Figure 4:
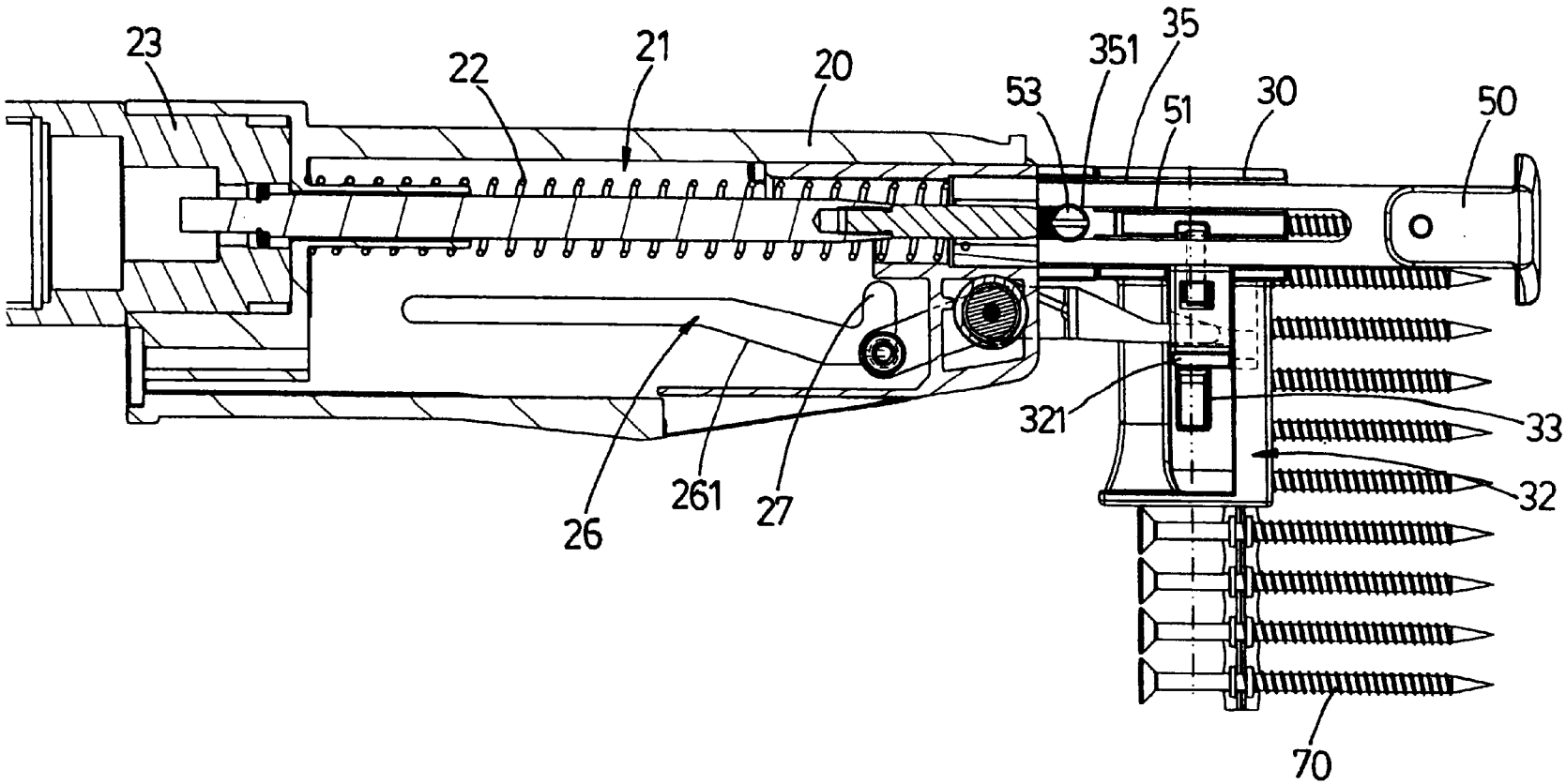
FIG. 4 is a side view to show the screw dispensing device of the present invention.
Figure 5:
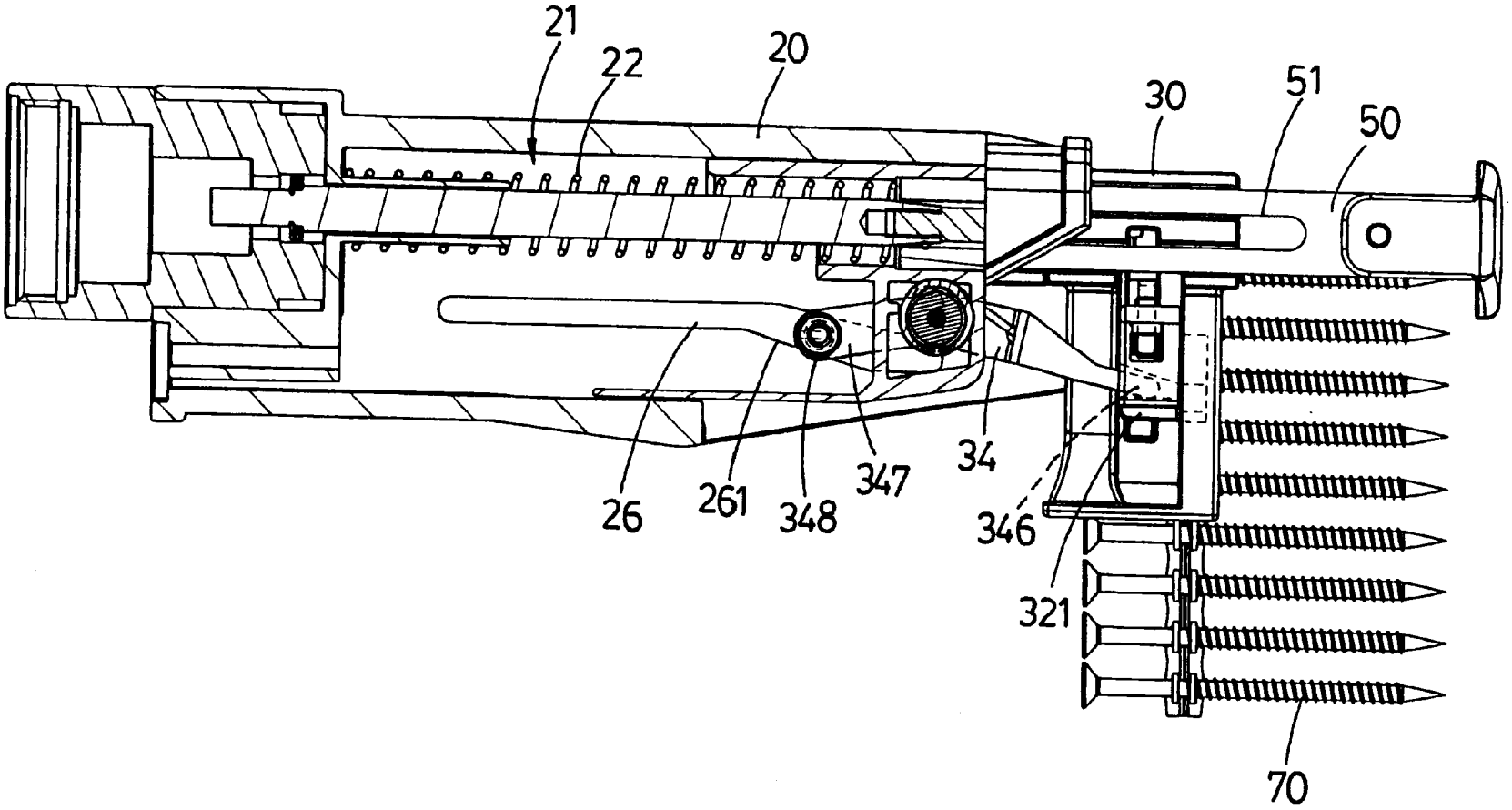
FIG. 5 is a side view to show the screw dispensing device of the present invention wherein the guide rod is located in the inclined slot.
Figure 6:
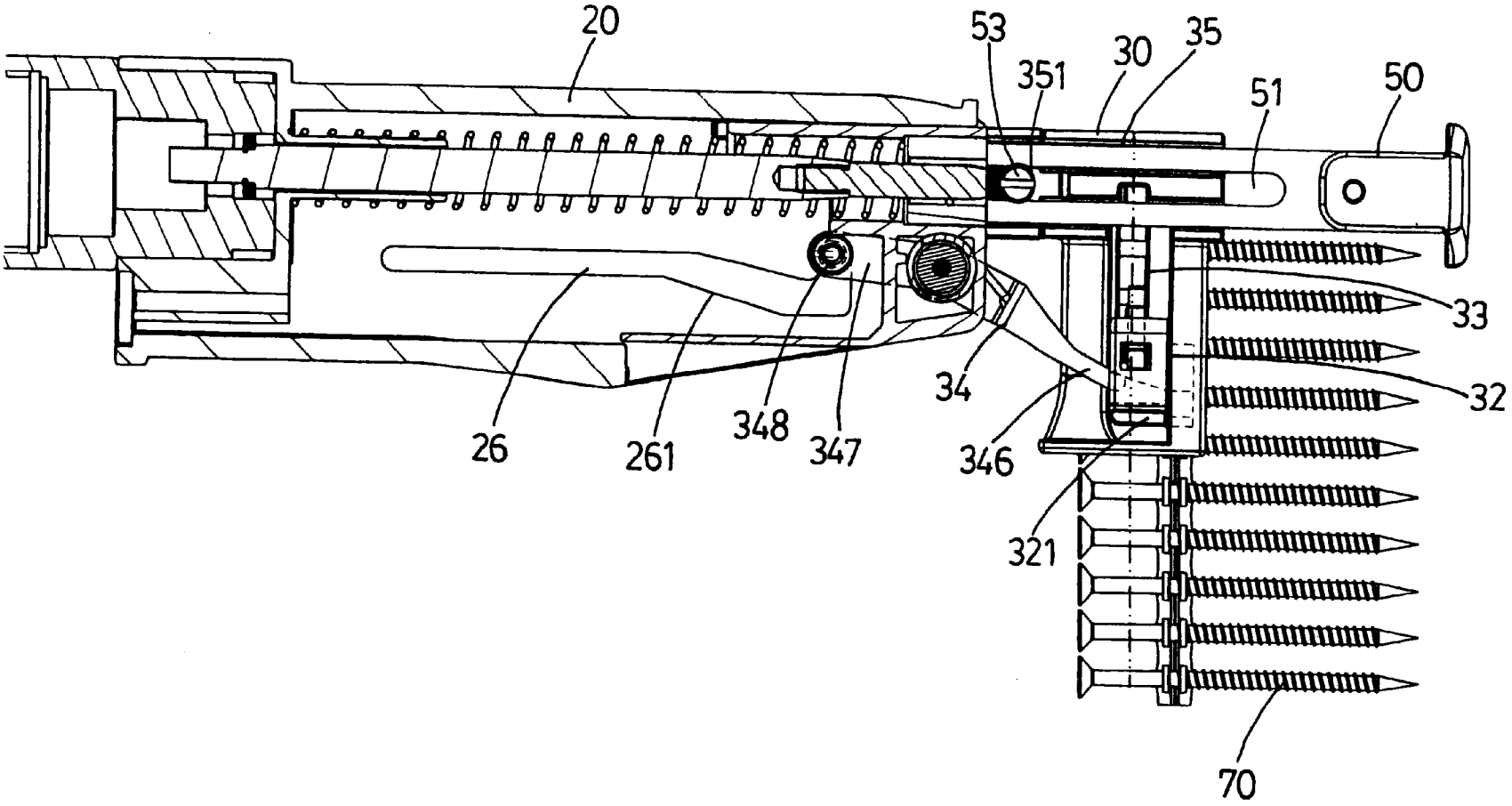
FIG. 6 is a side view to show the screw dispensing device of the present invention wherein the guide rod is located in the vertical release slot.

Referring to FIGS. 3 to 6, the screw dispensing device of the present invention comprises a sleeve 20, a barrel 30, a slide piece 40, a pushing member 42, a positioning plate 50 and an adjusting knob 60.

Figure 10:
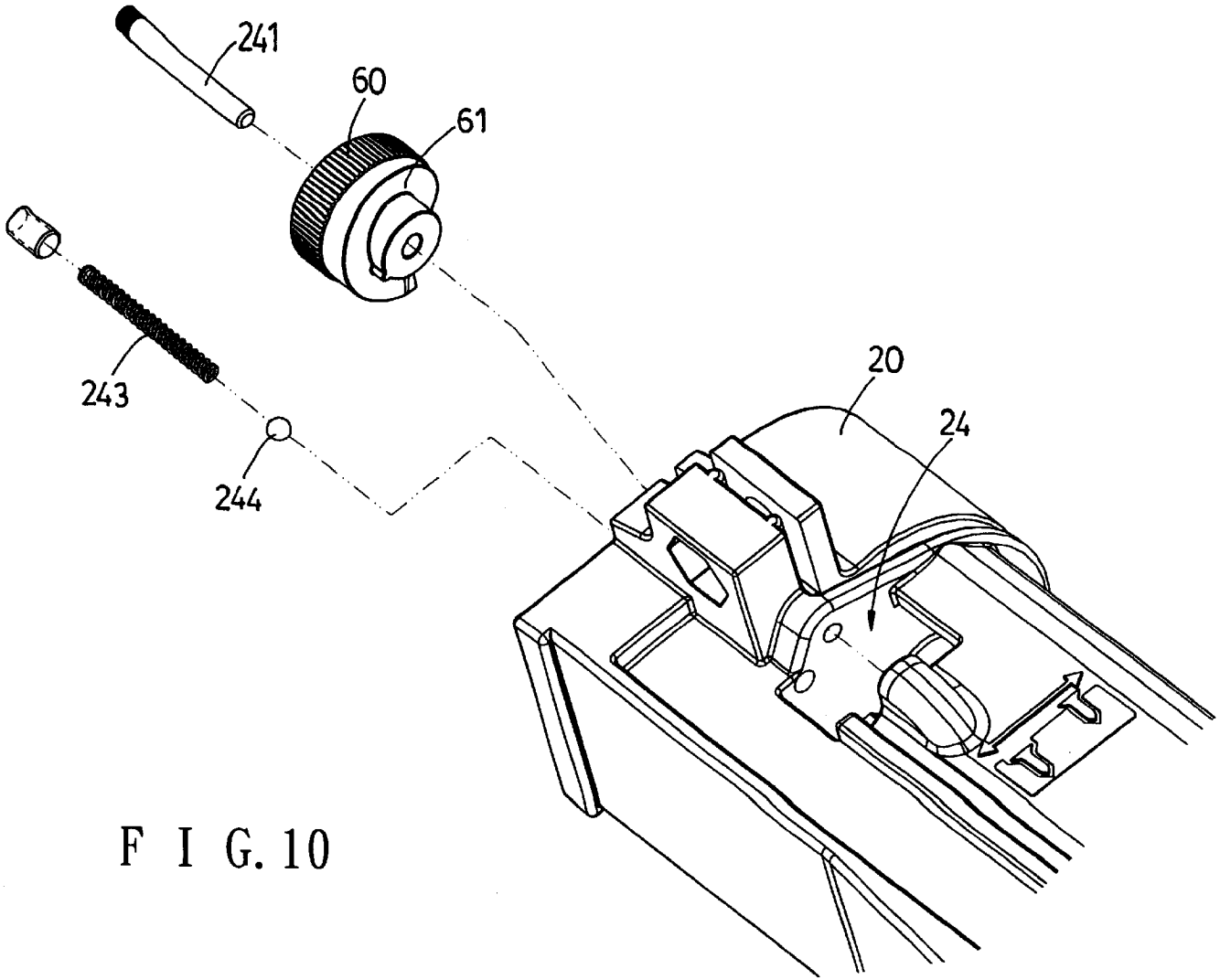
FIG. 10 is a similar exploded view viewed from the other side of the barrel.
Figure 11:
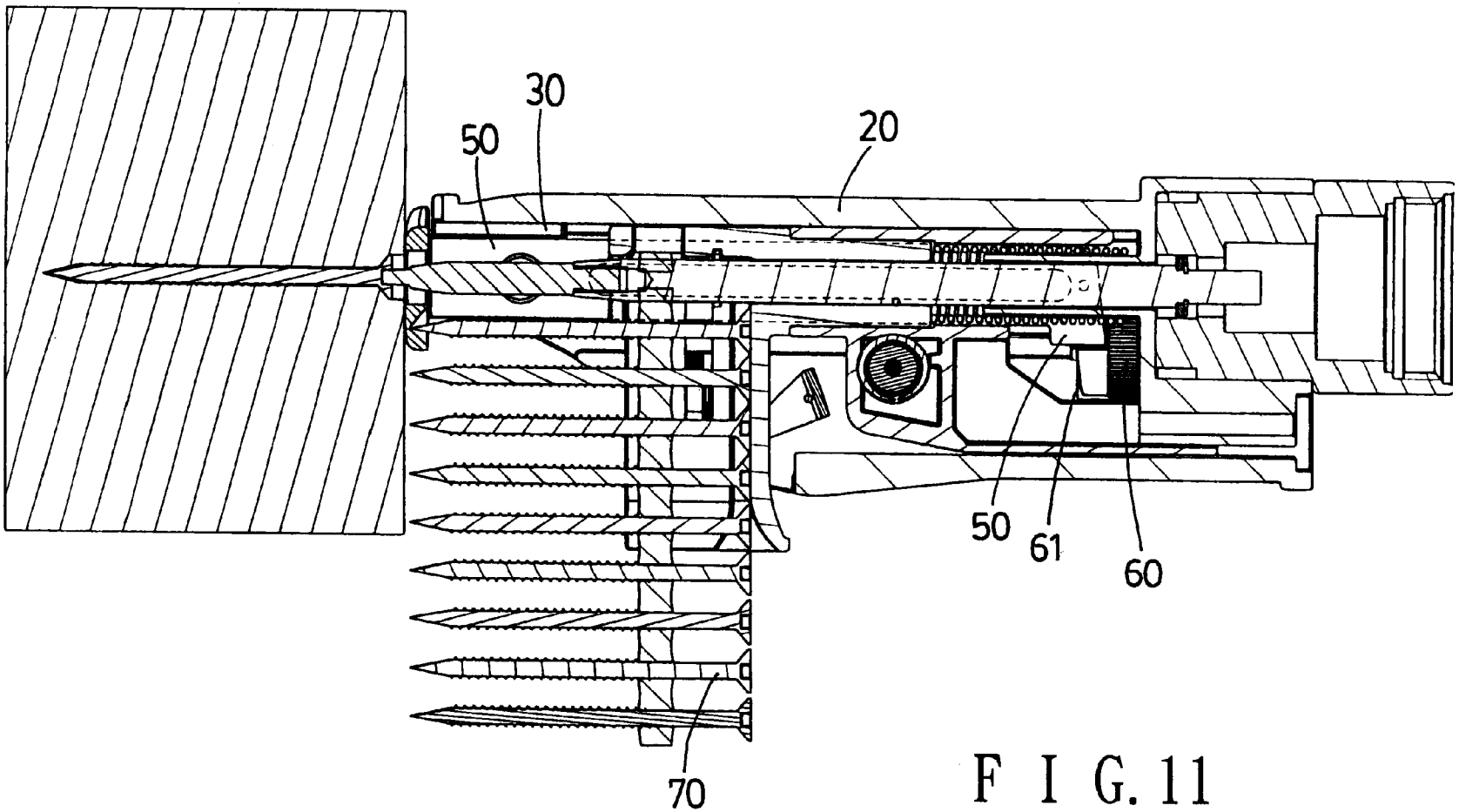
FIGS. 11 and 12 show the positioning plate controls the depth of the screws penetrating into the object.
Figure 12:
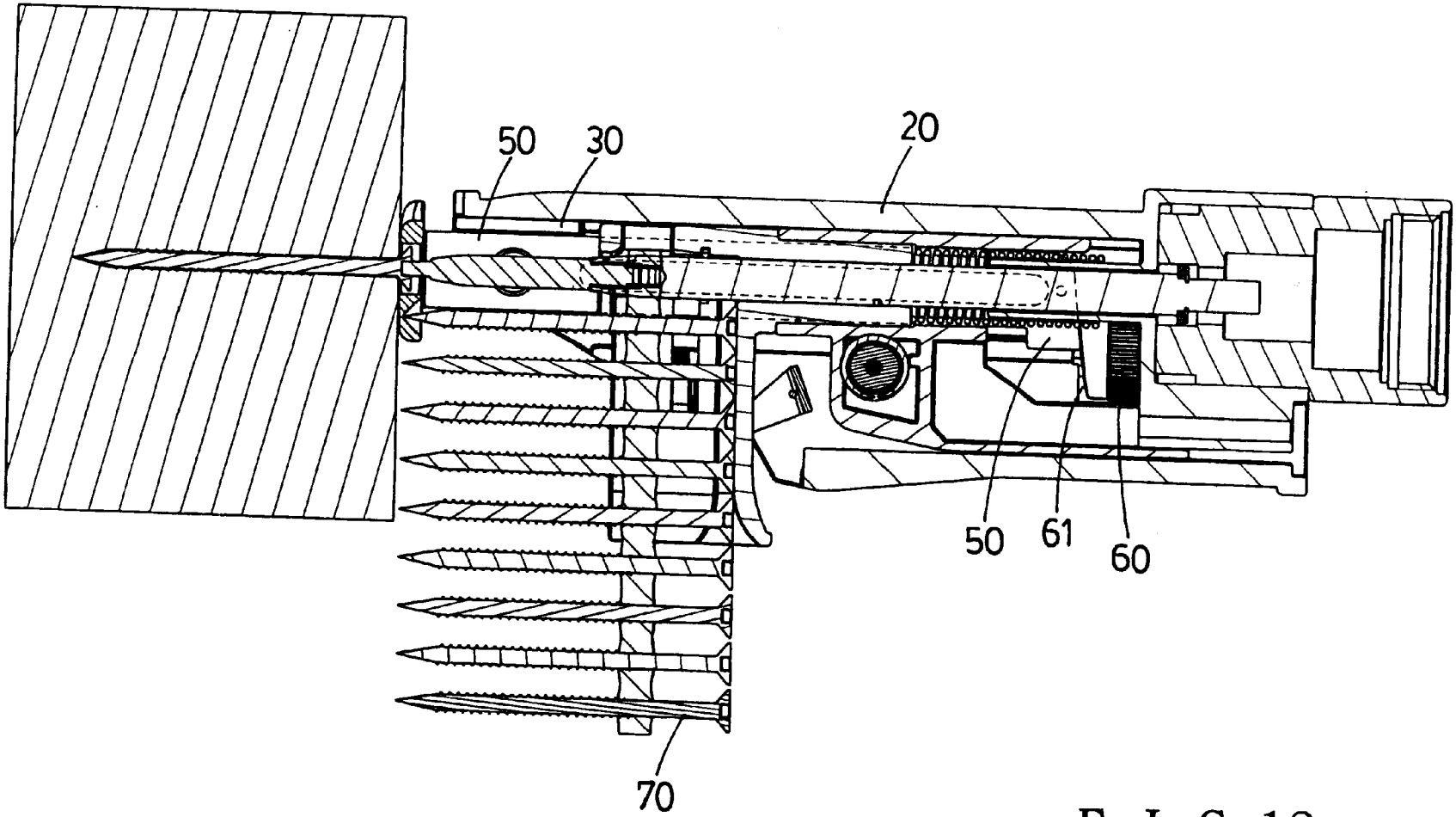

The sleeve 20 has a passage 21 with a spring 22 and a shaft 71 received therein, a positioning frame 23 connected to the sleeve 20 to position the spring 22 in the passage 21. As shown in FIG. 10, an opening 24 is defined in a periphery of the passage 21 and a pin 241 is pivotably connected to a periphery of the opening 24. A recess 242 is defined beside the pin 241 in the sleeve 20 and a bead 244 and a spring 243 are respectively received in the recess 242. A straight slot 25 is defined through the wall of the sleeve 20 and a limit slot 26 communicates with the straight slot 25, the limit slot 26 includes an inclined slot 261 which extends inclinedly and upward relative to the limit slot 26. A vertical release slot 27 communicates with the inclined slot 261.

The barrel 30 has an outlet 301 at an end thereof and is connected to the sleeve 20 corresponding to the passage 21. A positioning screw 31 extends through the straight slot 25 of the sleeve 20 so as to retrain the barrel 30 removably in the passage 21 of the sleeve 20 by the spring 22. An inlet 32 is defined in the lower position of the outlet 301 and a pushing hole 33 is defined in an upper position of the inlet 32. A pushing member 34 is connected to pushing hole 33 and a mediate portion of the pushing member 34 is fixed to the barrel 30 by a rivet 341 together with a first bush 342, a second bush 343, a torsion spring 344 and a washer 345. A first end 346 of the pushing member 34 is located beside the pushing hole 33, and a guide rod 348 extends through a second end 347 of the pushing member 34 and is engaged with the limit slot 26 of the sleeve 20. A slide slot 35 and a threaded hole 351 are defined in the barrel 30 and located on the opposite side of the barrel 30. A pressing plate 36 is connected to the barrel 30 and located corresponding to the inlet 32. The pressing plate 36 is a flexible plate and includes a folded stop surface 361 on a side thereof and the stop surface 361 is located corresponding to the screws 70.

The sliding piece 40 is an L-shaped plate and is engaged with the inlet 32 of the barrel 30. A spring pin 31 is connected to a top of the slide piece 40 and located in correspondence with the pushing hole 33 of the inlet 32. An opening 411 is defined in a side of the slide piece 40 and the first end 346 of the pushing member 34 extends through the opening 411. The short end of the L-shaped slide piece 40 protrudes out from the inlet 32 and forms a lever 321.

The pushing member 42 is pivotably connected to the spring pin 41 of the pushing member 42 by a pushing spring 43 and the protrusion portion of the pushing member 42 is pushed into the inlet 32 of the barrel 30 by the pushing spring 43. The protrusion portion of the pushing member 42 is located in correspondence with the pushing hole 33 of the barrel 30.

The positioning plate 50 is located that a pre-set distance is defined between a front end of the positioning plate 50 and the outlet 301 of the barrel 30. An operation slot 51 is defined longitudinally in the central portion of the positioning plate 50 and an end of a spring 52 is engaged with the operation slot 51 and the other end of the spring 52 is connected to a guide screw 53 which extends through the operation slot 51 and is fixed with the threaded hole 351 of the barrel 30. This makes the positioning plate 50 to be able to be movably retained in the slide slot 35 of the barrel 30. A rear end of the positioning plate 50 is located in correspondence with the opening 24.

The adjusting knob 60 is a circular member which has several stepped surfaces 61 defined in one side thereof and a plurality of dimples 62 are defined in the other side of the adjusting knob 60. The pin 241 extends through the adjusting knob 60 and the bead 244 is engaged with one of the dimples 62. The rear end of the positioning plate 50 is engaged with one of the stepped surfaces 61.

Figure 7:
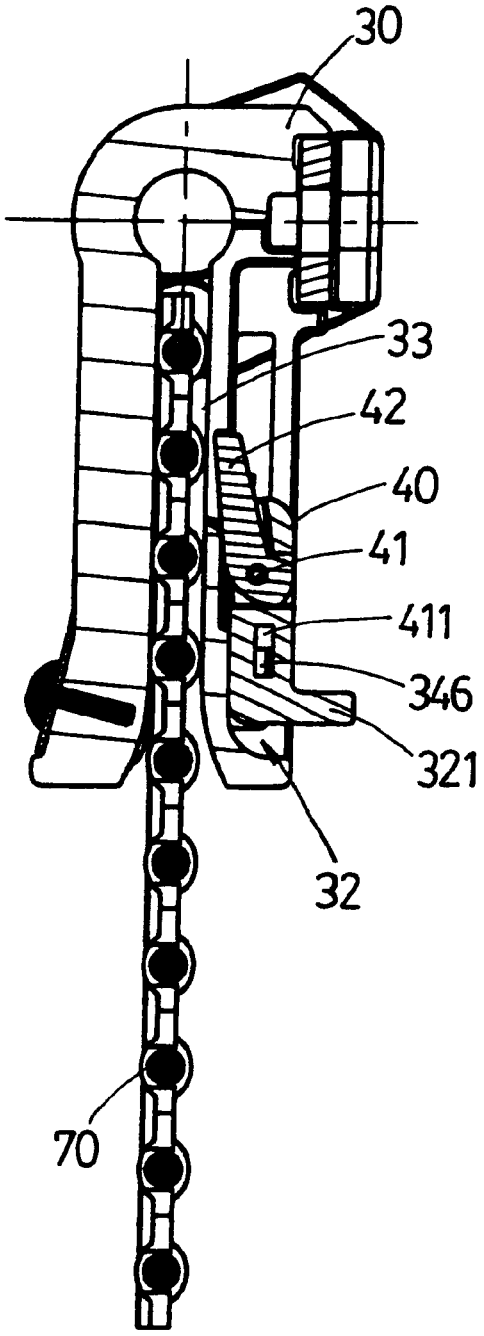
FIG. 7 is a cross sectional view to show the slide piece pressing the screws.
Figure 8:
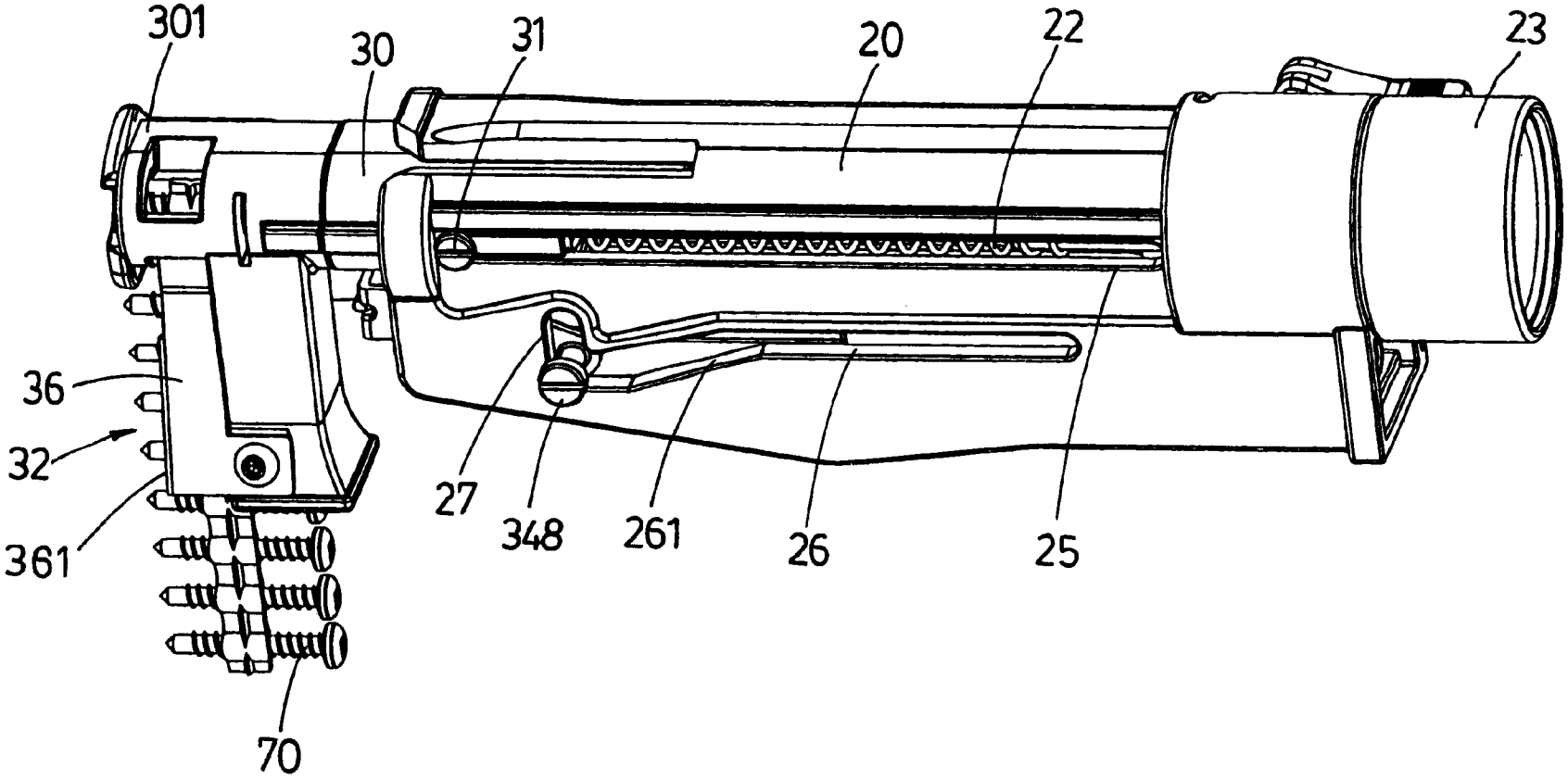
FIG. 8 is a perspective view to show the screw dispensing device of the present invention.

Referring to FIGS. 7 and 8, when changing the screws 70, the lever 321 of the slide piece 40 is pushed by the user so as to lower the pushing member 42, the protrusion portion of the pushing member 42 is pushed inward by the periphery of the pushing hole 33 so that the screws 70 can be smoothly inserted in the inlet 32 located at in front of the outlet 301. In the meanwhile, the second end 347 of the pushing member 34 makes the guide rod 348 slide to the vertical release slot 27 of the limit slot 26. Only one action is required to complete the action of pushing the screws 70 downward by the pushing member 42.

Due to the pre-sect distance between the front end of the positioning plate 50 and the outlet 301 of the barrel 30, the positioning plate 50 can be freely slid by the spring 52 so that screws with different sizes can be inserted in the outlet 301 of the barrel 30. Therefore, the length of the outlet 301 does not need to be adjusted for the screws 70 with different sizes.

Figure 9:
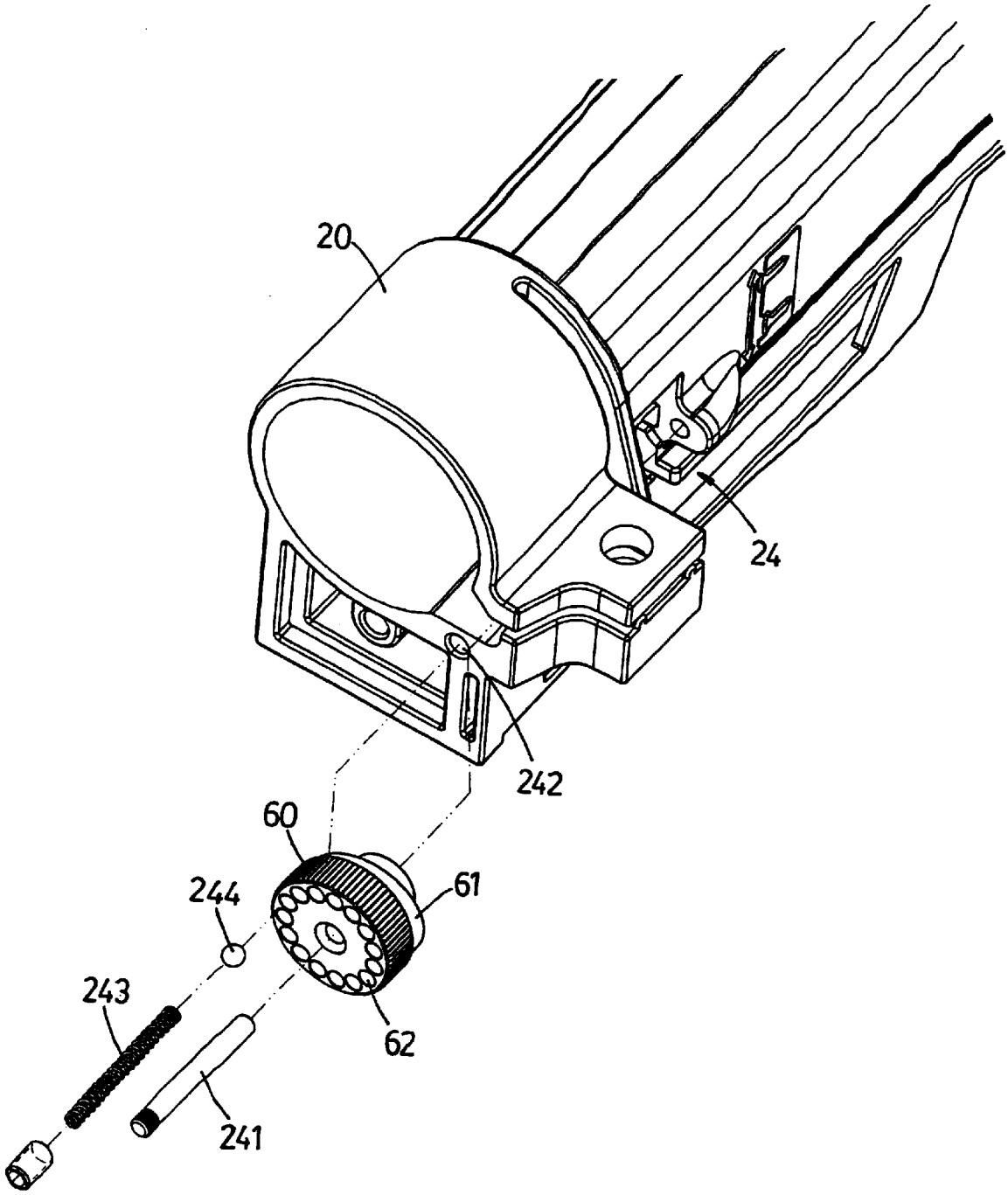
FIG. 9 is an exploded view to show the adjusting knob, the pin, the bead and the spring.

Further referring to FIGS. 9 and 10, the stepped surfaces 61 contact the rear end of the positioning plate 50, so that the depth of the screws 70 to be inserted in the object can be controlled by using the adjusting knob 60. The bead 244 engaged with the dimple 62 makes the control of the depth of the screws 70 be easy.

The folded stop surface 361 of the pressing plate 361 positions the screws 70 in the inlet 32 and the flexible force of the pressing plate 361 ensures the screws 70 not to shake up and down.

While we have shown and described the embodiment in accordance with the present invention, it should be clear to those skilled in the art that further embodiments may be made without departing from the scope of the present invention.

What is claimed is:

1. A screws dispensing device comprising:

a sleeve having a passage with a spring received therein, a positioning frame connected to the sleeve to position the spring in the passage, an opening defined in a periphery of the passage and a pin pivotably connected to a periphery of the opening, a recess defined beside the pin in the sleeve, a bead and a spring respectively received in the recess, a straight slot defined through a wall of the sleeve and a limit slot communicating with the straight slot, the limit slot including an inclined slot which extends inclinedly and upward relative to the limit slot, a vertical release slot communicating with the inclined slot;

a barrel having an outlet at an end thereof and inserted in the passage of the sleeve, a positioning screw extending through the straight slot of the sleeve and retraining the barrel removably in the passage of the sleeve by the spring, an inlet defined in the lower position of the outlet and a pushing hole defined in an upper position of the inlet, a pushing member connected to pushing hole and pivotably connected to the barrel, a first end of the pushing member located beside the pushing hole, a guide rod extending through a second end of the pushing member and engaged with the limit slot of the sleeve, a slide slot and a threaded hole defined in the barrel and located on an opposite side of the barrel;

an L-shaped sliding piece and engaged with the inlet of the barrel, a spring pin connected to a top of the slide piece and located in correspondence with the pushing hole of the inlet, an opening defined in a side of the slide piece and the first end of the pushing member extending through the opening, a short end of the L-shaped slide piece protruding out from the inlet and forming a lever;

a pushing member pivotably connected to the spring pin of the pushing member by a pushing spring and a protrusion portion of the pushing member inserted into the inlet of the barrel by the pushing spring, the protrusion portion of the pushing member located in correspondence with the pushing hole of the barrel;

a positioning plate located at a position where a pre-set distance is defined between a front end of the positioning plate and the outlet of the barrel, an operation slot defined longitudinally in the central portion of the positioning plate and an end of a spring engaged with the operation slot and the other end of the spring connected to a guide screw which extends through the operation slot and is fixed with the threaded hole of the barrel such that the positioning plate is movably retained in the slide slot of the barrel, a rear end of the positioning plate located in correspondence with the opening; and a circular adjusting knob having a plurality of stepped surfaces defined in one side thereof and a plurality of dimples defined in the other side of the adjusting knob, the pin extending through the adjusting knob and the bead engaged with one of the dimples, the rear end of the positioning plate engaged with one of the stepped surfaces.

* * * * *